US010301880B2

(12) United States Patent
Bullock et al.

(10) Patent No.: US 10,301,880 B2
(45) Date of Patent: May 28, 2019

(54) OVER-BIT REAMER

(71) Applicant: Radius HDD Direct, LLC, Perry, OK (US)

(72) Inventors: David G. Bullock, Weatherford, TX (US); Ronald F. Wright, Jr., Weatherford, TX (US)

(73) Assignee: Radius HDD Direct, LLC, Perry, OK (US)

( * ) Notice: Subject to any disclaimer, the term of this patent is extended or adjusted under 35 U.S.C. 154(b) by 224 days.

(21) Appl. No.: 15/276,336

(22) Filed: Sep. 26, 2016

(65) Prior Publication Data

US 2017/0089143 A1 Mar. 30, 2017

Related U.S. Application Data

(60) Provisional application No. 62/232,538, filed on Sep. 25, 2015.

(51) Int. Cl.

| | |
|---|---|
| ***E21B 7/28*** | (2006.01) |
| ***E21B 7/04*** | (2006.01) |
| ***E21B 10/26*** | (2006.01) |
| ***E21B 10/32*** | (2006.01) |

(52) U.S. Cl.

CPC ..... *E21B 7/28* (2013.01); *E21B 7/046* (2013.01); *E21B 10/26* (2013.01); *E21B 10/327* (2013.01)

(58) Field of Classification Search

CPC ..... E21B 10/26; E21B 10/083; E21B 10/30

See application file for complete search history.

(56) References Cited

U.S. PATENT DOCUMENTS

| | | | |
|---|---|---|---|
| 5,220,964 | A | 6/1993 | Deken et al. |
| 6,250,403 | B1 | 2/2001 | Beckwith |
| 7,137,460 | B2 | 11/2006 | Slaughter, Jr. et al. |
| 7,243,737 | B2 | 7/2007 | Michael |
| 8,122,979 | B1 | 2/2012 | Wright, Jr. et al. |
| 2014/0338982 | A1* | 11/2014 | Wright, Jr. ..... E21B 7/046 175/73 |

* cited by examiner

*Primary Examiner* — David J Bagnell
*Assistant Examiner* — Manuel C Portocarrero
(74) *Attorney, Agent, or Firm* — Tomlinson McKinstry, P.C.

(57) ABSTRACT

An over-bit backreamer. The backreamer is configured to be placed over a bit without detaching the hit from a drill string associated with a pilot bore. The backreamer has an internal surface that conforms to a steering surface of the hit. Rotation is transferred from the bit to the backreamer at the internal surface. The backreamer further defines a flange which interacts with a feature, such as a heel, on the bit. The flange and heel form a shoulder which transfers pullback force to the bit. The backreamer comprises a pullback eye that pulls a product pipe back through the borehole.

22 Claims, 10 Drawing Sheets

OVER-BIT REAMER

CROSS REFERENCE TO RELATED APPLICATION

This application claims the benefit of U.S. Provisional Patent Application Ser. No. 62/232,538 filed on Sep. 25, 2015, the entire contents of which are incorporated herein by reference.

FIELD

This invention relates generally to backreamers for horizontal directional drill operations.

SUMMARY

The invention is directed to a backreamer comprising a cutting face and a body. The cutting face comprises a plurality of teeth. The body defines an internal cavity. The internal cavity is characterized by an internally disposed keying surface and an opening formed proximate the cutting face.

In another embodiment, the invention is directed to a kit comprising a bit and a backreamer. The bit comprises a slanted steering face, a heel, and a connection point configured to connect to a drill string. The backreamer comprises a cutting face and a body defining an internal cavity. The internal cavity is characterized by an internally disposed surface in torque-transmitting relationship with the slanted steering face of the bit.

In another embodiment, the invention is directed to a backreamer having an internal cavity defined by a flange and a slanted internal surface such that a bit at least partially disposed inside the internal cavity may impart rotational and pullback force to the backreamer.

In another embodiment, the invention is directed to a method. The method comprises drilling a pilot bore with a bit and a drill to an exit point, placing a backreamer having an internal cavity about the bit such that the bit is at least partially disposed inside the backreamer, rotating the drill string and bit to rotate the backreamer, and pulling the backreamer back towards the drill with the bit to enlarge the pilot bore.

DESCRIPTION OF THE PREFERRED EMBODIMENTS

With reference to the figures in general, shown therein is a kit 10 for boring and backreaming a borehole. The kit 10 comprises a rock bit 12 and an over-bit backreamer 14. The rock bit 12 comprises a longitudinal axis 13 and an external geometry of a type known in the industry to be advantageous for horizontal directional drilling (HDD) activities. One particular type of drill bit that may be utilized with the kit 10 is the bit shown in U.S. Pat. Pub. No. 2014/0338982, issued to Wright, the contents of which are incorporated by reference herein.

Figure 2:
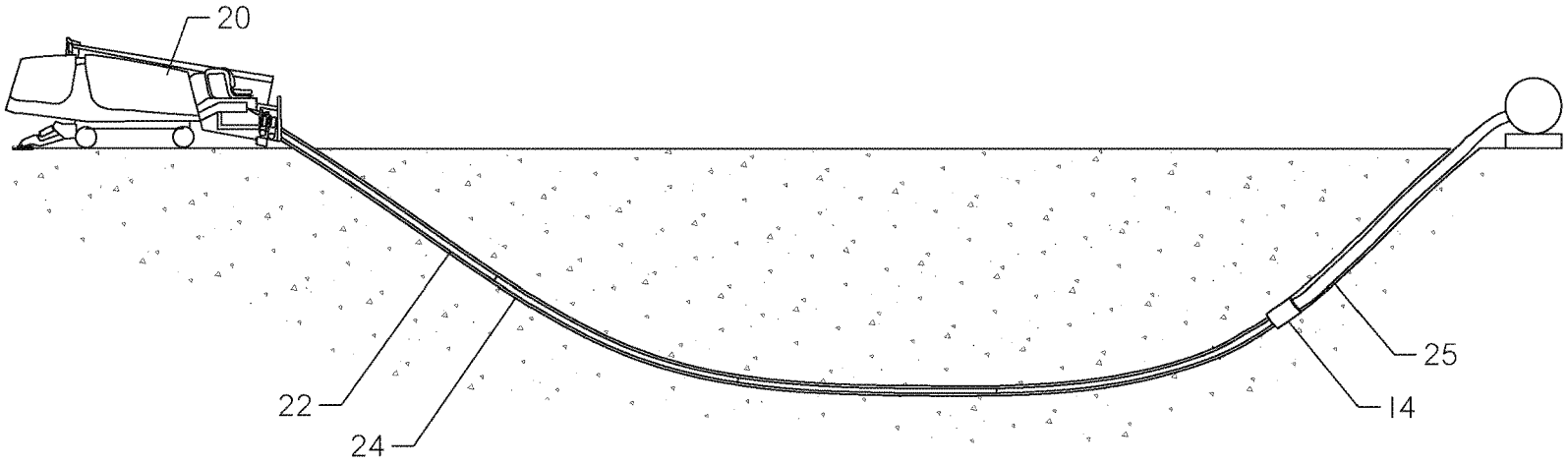
FIG. 2 is a diagrammatic representation of a backreaming operation.

The kit 10, when used together, enables the over-bit backreamer 14 to be utilized without removing the rock bit 12 from a drill string. With reference to FIG. 2, shown therein is a backreaming operation. A horizontal directional drill 20 provides thrust and rotation for a drill string 22 and terminally-situated rock bit 12. The rock bit 12 is advanced to an exit point to create a pilot bore 24. In prior at applications, the rock bit 12 would be removed from the drill string 22 and a dedicated backreamer attached thereto. The backreamer is then rotated and retracted by the drill 20 to enlarge the pilot bore 24 and place a product pipe 25.

In the present invention, the over-bit backreamer 14 is placed around the rock bit 12. Mating features, as will be described below, allow the rock bit 12 to provide rotational and pull-back force to the backreamer 14 such that no separate attachment between the backreamer and the drill string 22 is required.

Figure 3:
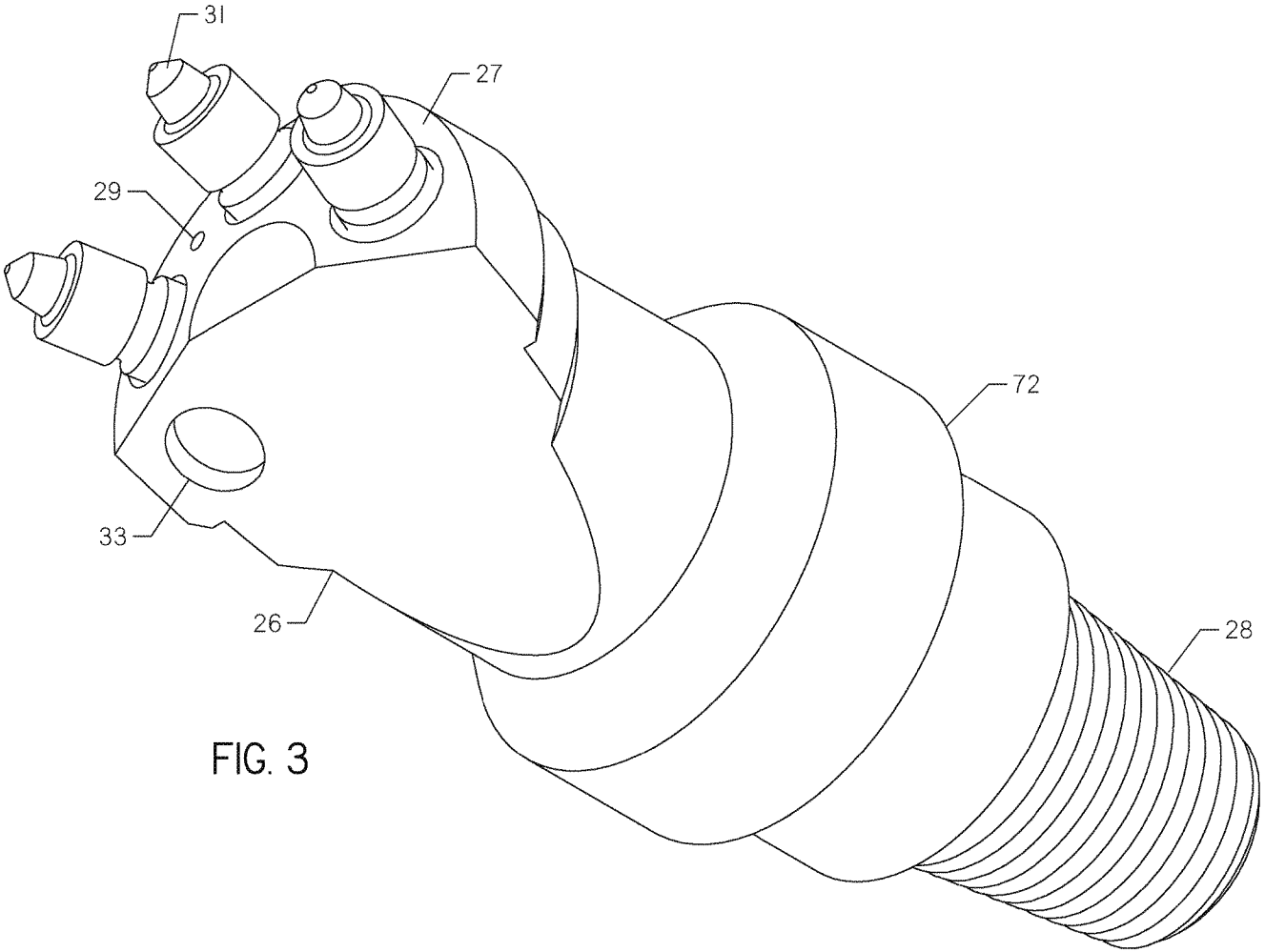
FIG. 3 is a perspective view of the rock bit of FIG. 1.

The operation of the rock bit 12 is known to artisans at the time of the invention and provided herein background. The rock bit 12 may have one of many orientations known in the art. As shown in FIG. 3, the rock bit 12 comprises a slanted steering face 26, a forward-facing cutting face 27 and a drill string connection 28. The cutting face may comprise one or more teeth 31. The cutting face 27 removes material from the forward end of the bit 12 as the drill string 22 opens the pilot bore 24. The cutting face 27 or steering face 26 may define one or more fluid ports 29 for conveying drilling fluid from the drill string 22 to a location proximate the cutting face. Drilling fluid assists the cutting face 27 in opening the pilot bore 24.

The slanted steering face 26 is at an angle relative to the longitudinal axis 13 of the bit 12. Therefore, as the rock bit 12 is advanced with full rotation, the drill string is advanced in a generally straight path. When the rock bit 12 is advanced without full rotation, the drill string is advanced in a direction away from the steering face 26. The slanted steering face 26 may comprise a mating feature 33 such as a button hole, key, or spline. Such a mating feature 33 aids the rock bit in securely mating with the backreamer 14 (FIG. 1) in the kit 10.

The drill string connection 28 may be a threaded, splined, bolted, or other known connection between the rock bit 12 and the drill string 22 (FIG. 2).

Figure 4:
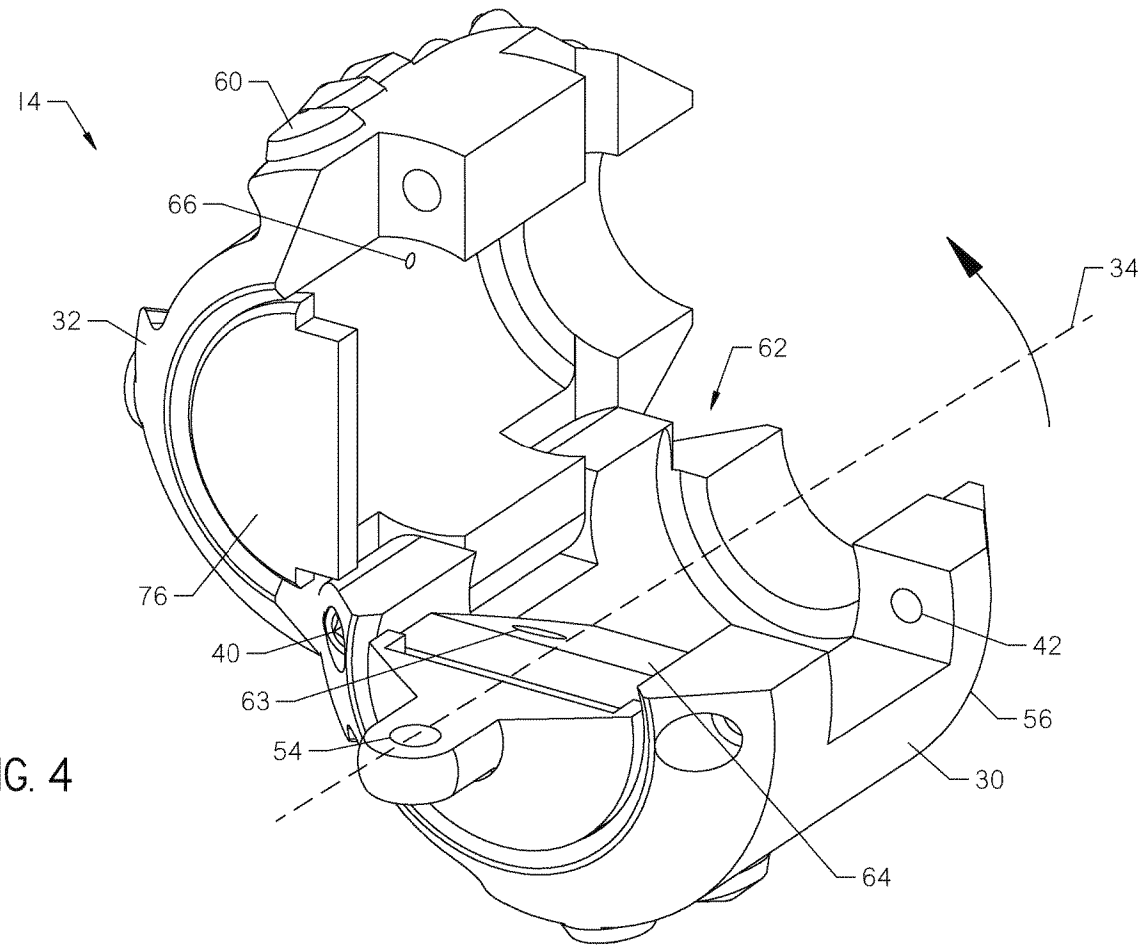
FIG. 4 is a perspective view of the backreamer of FIG. 1 in an open orientation.
Figure 5:
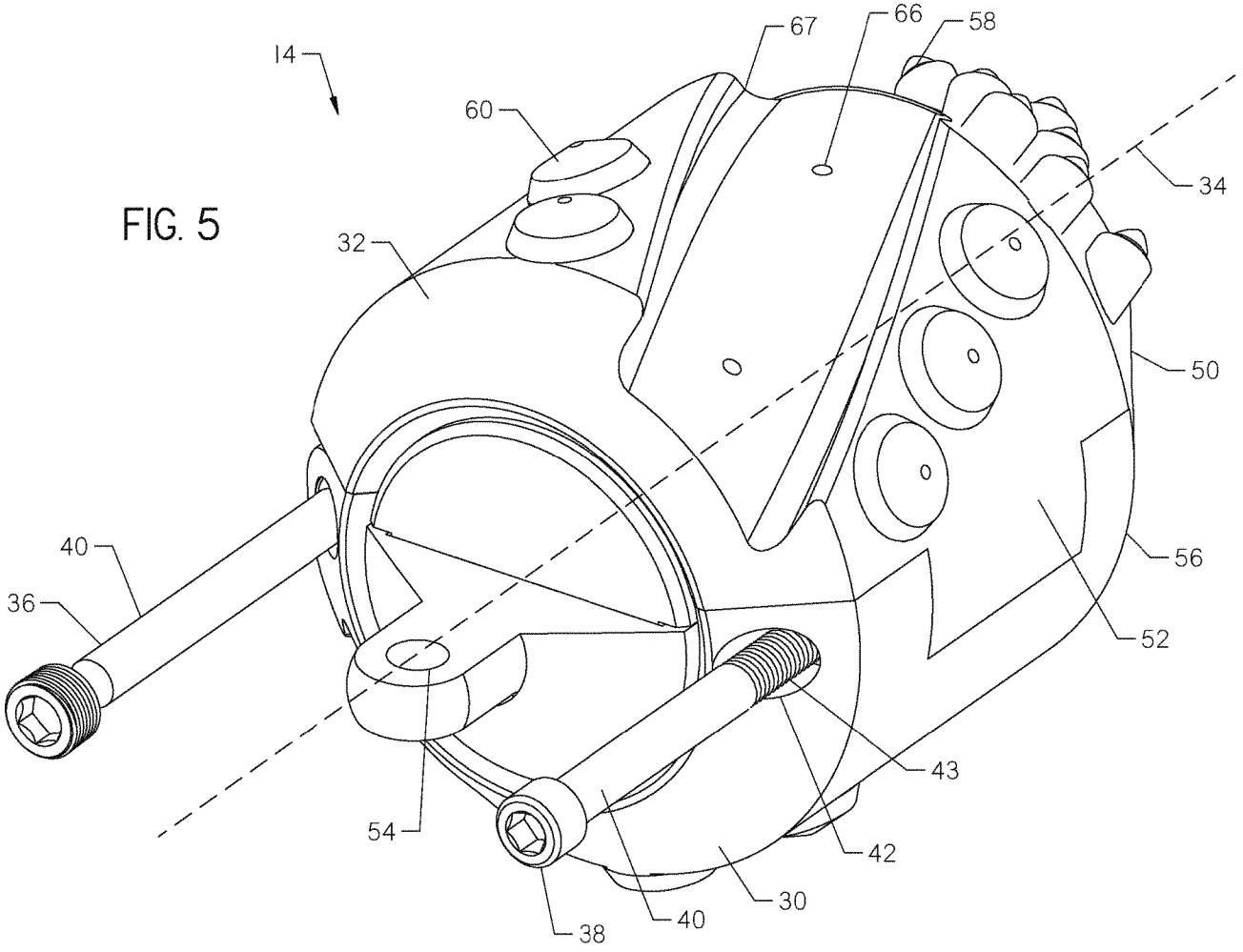
FIG. 5 is a perspective view of the backreamer of FIG. 1 in a closed orientation with its pins removed.

With reference now to FIG. 4-5, the over-bit backreamer 14 comprises a first section 30 and a second section 32 disposed about a longitudinal axis 34. Each section 30, 32 may make up significant portions (at least 90 degrees) of a circumferential exterior of the backreamer 14. As shown in the figures, the first section 30 and second section 32 each make up approximately one half of the back reamer.

The features of the first section 30 and second section 32 are discussed as displayed in FIGS. 4-5, but, as two parts of a whole, these features may be placed on the opposite section without departing from the spirit of the invention.

As shown in FIG. 5, the backreamer comprises a first connecter 36 and a second connecter 38. Each connecter 36, 38 is located where the first section 30 and second section 32 meet. As shown, the connecters 36, 38 comprise a pinned joint. The pinned joint consists essentially of a pin 40 and corresponding slots 42. The pin 40 may comprise threads 43 and the slots 42 may comprise corresponding lands. Alternatively, other joints may be utilized, such as splined connections, dedicated hinges, bolted connections, keyed connections, or interlocks.

Figure 7:
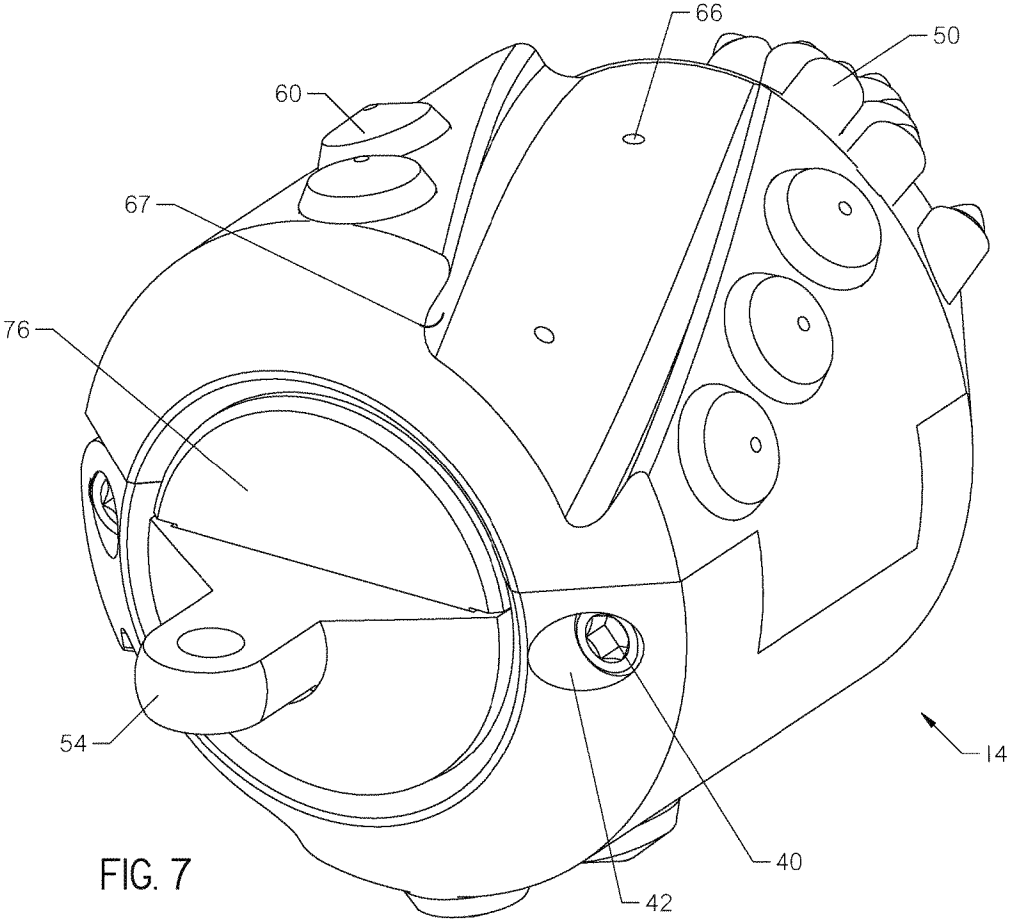
FIG. 7 is a perspective view of the backreamer of FIG. 1 in a closed orientation.

As shown, the connectors 36, 38 enable three orientations of the backreamer 14. A first orientation is defined by both pins 40 being located in corresponding slots 42 such that the backreamer is made up and in one piece as shown in FIG. 7. In the second orientation, as shown in FIG. 4, one pin 40 is disconnected. This causes the connected connector 36 or 38 to act as a "hinge" for the backreamer 14. In this orientation, the rock bit 12 (FIG. 3) may access the internal portions of the backreamer 14 and be partially enclosed therein. In the third orientation, both pins 40 are removed, as shown in FIG. 5. This allows the first section 30 and second section 32 to be disconnected completely.

Figure 8:
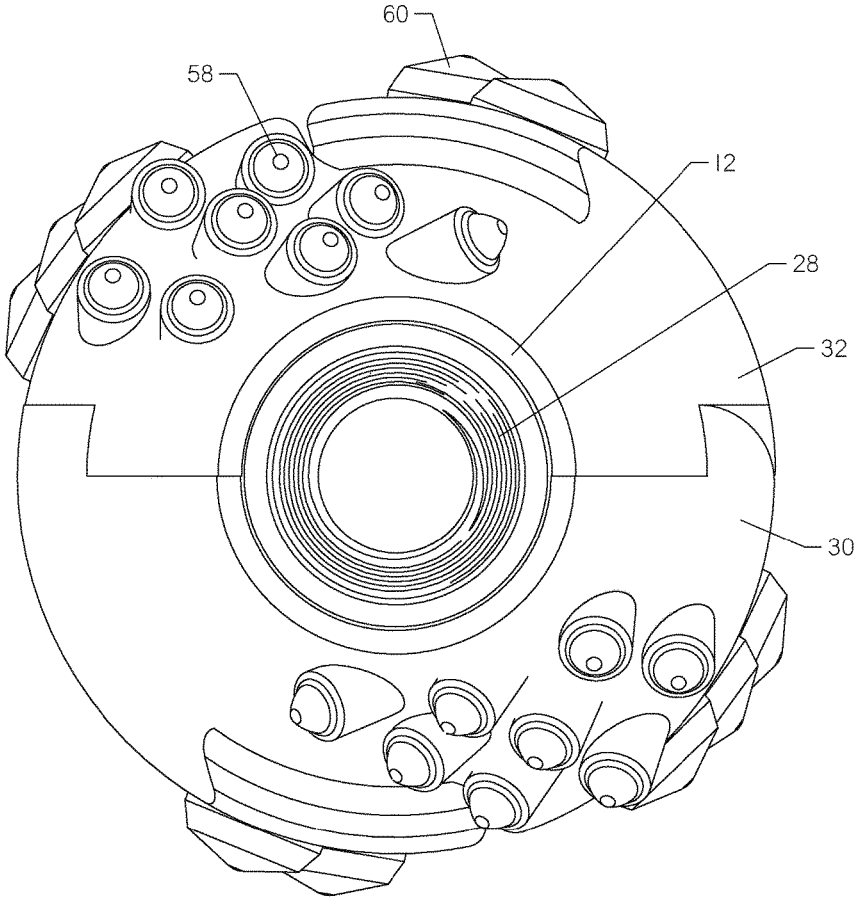
FIG. 8 is an end view of the kit with the rock bit disposed within the backreamer.

The backreamer comprises a cutting surface 50, a body 52, and a pullback eye 54. The cutting surface 50 is located on a first end 56 of the backreamer 14 and comprises a plurality of cutting teeth 58. The first end 56 of the backreamer is the end closest to the drill string 22 (FIG. 2). The plurality of cutting teeth 58 may be oriented toward the drill string 22 or may be angled in a preferred direction of rotation of the backreamer 14 as shown in FIG. 8.

The body 52 comprises a plurality of buttons 60 and defines an internal cavity 62 having an internally disposed slanted surface 64 and at least one fluid port 66. The plurality of buttons 60 are disposed about an exterior of the body 52 and engage the enlarged bore hole. The buttons 60 may be made of a hardened material. Alternatively, the buttons may be made of the same material as body 52. Hardfacing may be utilized on an exterior of the body 52 to enhance durability. The exterior of the body 52 may define one or more flutes 67 disposed in a spiral fashion about the backreamer 14 to reduce friction and aid in backreaming operations. As shown in FIG. 5, the fluid ports 66 are located on the flutes 67.

The slanted surface 64 is at an angle relative to the longitudinal axis 34 of the backreamer 14 and is not orthogonal to axis 34. The slanted surface 64 is planar as shown, though curved or other orientations may be utilized, so long as relative rotation between the slanted surface 64 and rock bit 12 is not allowed when the backreamer 14 is partially disposed about the bit. The slanted surface 64 may define a mating feature 63 to enhance the connection between the backreamer 14 and a mating feature 33 on the rock bit 12 (FIG. 3). Mating feature 63 may be a button hole, a button, a key, a spline, or other such features.

Figure 6:
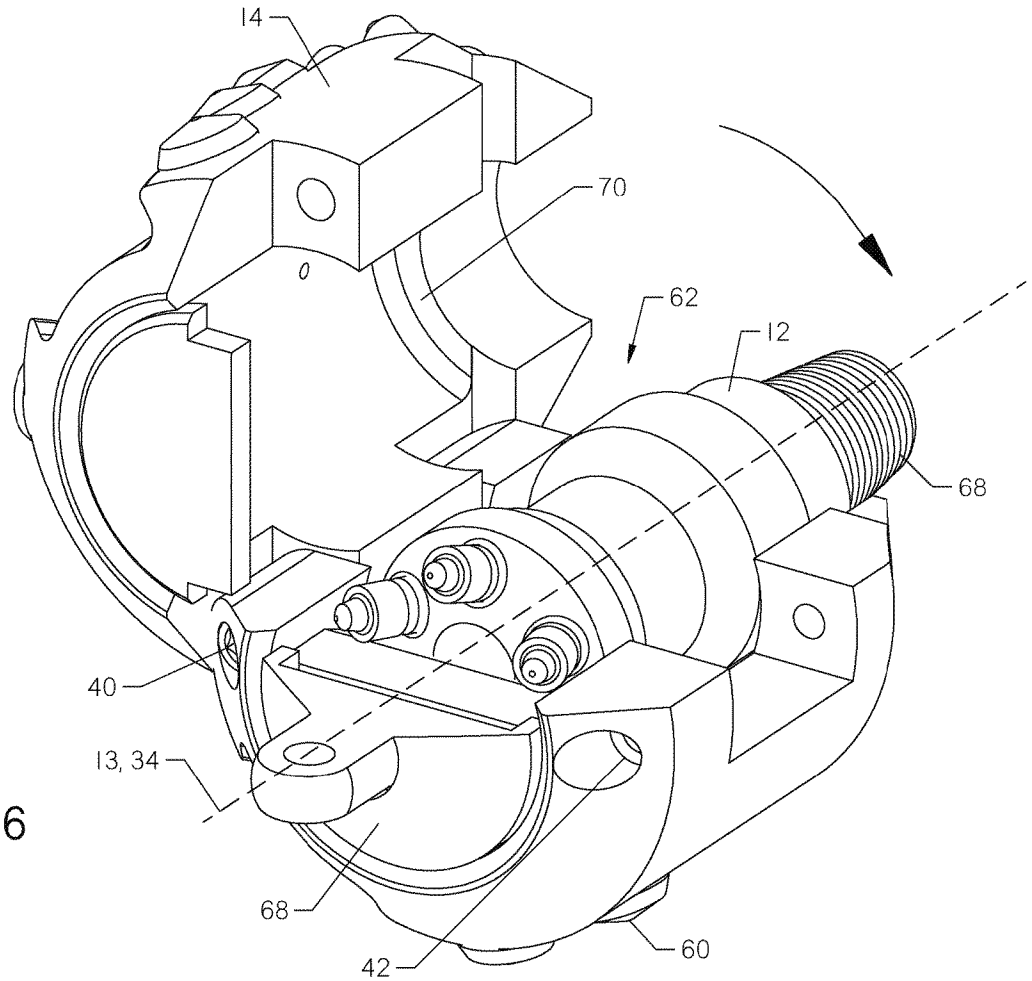
FIG. 6 is a perspective view of the kit of FIG. 1 with the rock bit placed inside the backreamer.

With reference to FIG. 6, the internal cavity 62 is sized to encapsulate the rock bit 12. Preferably, the slanted surface 64 (FIG. 5) of the backreamer 14 and steering face 26 (FIG. 3) of the rock bit 12 are conforming such that rotational torque may be transferred between the rock bit and backreamer. As discussed above, mating features 33, 63 may be utilized to enhance the connection between the backreamer 14 and the rock bit 12.

While it is optimal for the longitudinal axis 13 of the rock bit 12 and the longitudinal axis 34 of the backreamer 14 to be collinear, small variations may exist without impairing operation of the backreamer 14. For example, the axis 13 may be substantially collinear with the axis 34, as when the axes 13, 34 are both closer to each other than to an interior wall of the body 52. Additionally, some small deviation from parallel, such as a five to ten degree variance, will allow preferable operation of the backreamer 14. Likewise, while the angles of the slanted surface 64 and steering face 26 relative to the associated longitudinal axes 13, 34 are preferably equal, small deviations between these angles may exist without impairing the torque transfer associated with the invention. Preferably, the angles differ by no more than fifteen degrees.

When in the first orientation, an opening exists in the first end 56 of the body 52 such that the rock bit 12 may partially extend out of the internal cavity 62 of the backreamer 14. Preferably, the opening will conform closely to the portion of the rock bit 12 or drill string 22 (FIG. 2) that it surrounds.

Figure 9:
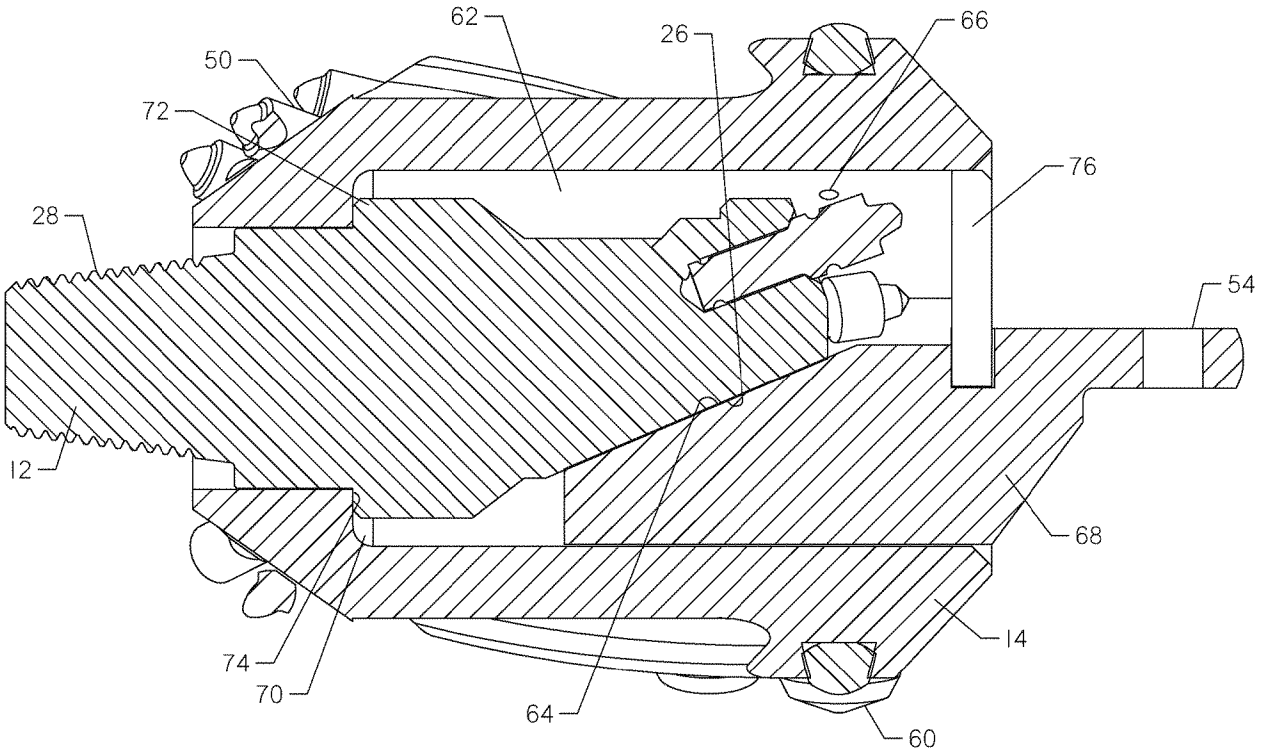
FIG. 9 is a sectional side view of the kit with the rock bit disposed within the backreamer.

As shown in FIGS. 4 and 9, the slanted surface 64 is disposed on an insert 68 that is attached to the interior of the body 52. The pullback eye 54 is integral with the insert 68. Alternatively, the pullback eye 54 and slanted surface may be integral with the body 52 or disposed on separate pieces. As shown, the insert 68 is shown attached to the first section 30 of the backreamer 14. However, the insert 68 may be on either of the sections 30, 32, or may be partially disposed on each section to be made up when the backreamer 14 is in the first orientation.

An end plate 76 may be attached to the second section 30 of the backreamer 14. The end plate 76 encloses the internal cavity 62 when the backreamer 14 is in the first orientation by mating with the insert 68.

At least one fluid port 66 exists through the body 52. The fluid port 66 allows the backreamer 14 to utilize drilling fluid from the drill string 22. The drilling fluid may travel through the drill string 22, out the fluid port 29 of the rock bit 12, and into the internal cavity 62. This fluid is then expelled through every opening in the backreamer 14, including fluid ports 66.

Figure 1:
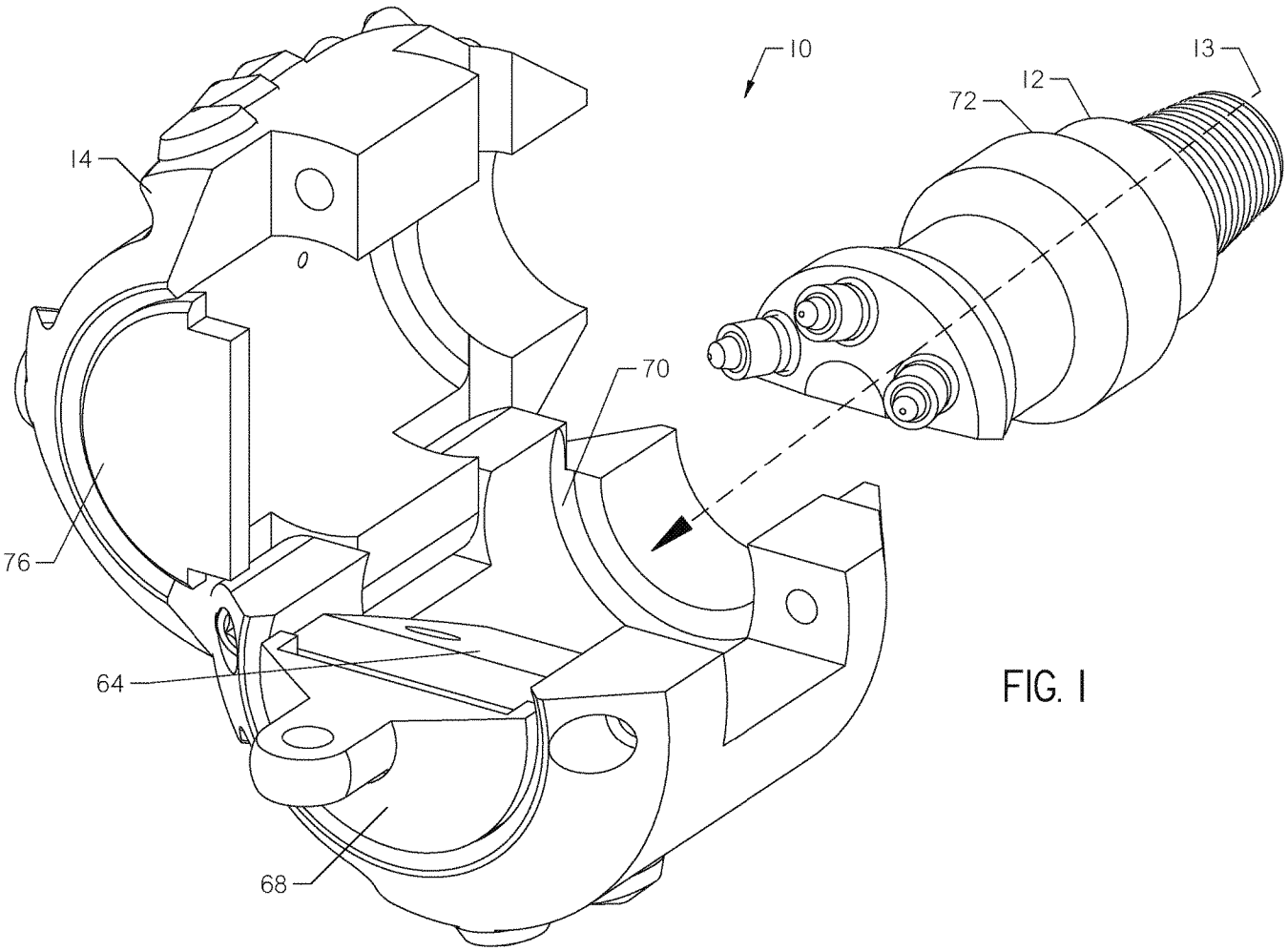
FIG. 1 is a perspective view of a kit composed of a rock bit and a backreamer.

As shown in FIGS. 1 and 6, the body 52 comprises a flange 70 set near the opening in the first end 56. The flange 70 has a diameter less than the diameter of the rock bit 12. The rock bit 12 may comprise a heel 72 that causes a portion of the rock bit 12 to have a diameter greater than that of the flange 70. The flange allows the rock bit 12 to transfer pullback force from the drill string 22 to the backreamer. As shown in FIG. 9, when the backreamer 14 is in the first orientation, the heel 72 and the flange 70 create a shoulder 74. The shoulder 74 and the mating of the end plate 76 and insert 68 cause the fluid ports 66 to be the primary path of drilling fluid from the internal cavity 62.

The backreamer 14 may have an internal cavity 62 sized to fit multiple different rock bits 12. For example, the backreamer 14 may have a preferred rock bit 12 (such as that provided in the kit 10) but may also be utilized with rock bits having similar sizes and features. The particular configuration of the rock bit 12 is immaterial so long as the rock bit fits within the internal cavity 62 and transfers torque and pullback force thereto. While the shoulder 74 and oriented slanted surface 62 is one means to do so, an artisan will appreciate that shims or other fasteners may be provided to secure the rock bit 12 within the backreamer 14.

The pullback eye 54 is preferably along the longitudinal axis 34 of the backreamer 14. The pullback eye 54 attaches to a product pipe 25 (FIG. 2) and pulls the product pipe through the newly enlarged borehole. The pullback eye 54 may swivel relative to the body 52 or may be static.

In operation, a kit 10 is utilized with a horizontal directional drill 20. A rock bit is provided at a distal end of a drill string 22. Using the drill 20 to provide rotation and thrust to the drill string 22, the rock bit 12 is advanced along a bore path to an exit point.

When making up the backreamer 14 and rock bit 12, the backreamer 14 will be placed in the second orientation, such as in FIG. 1. The slanted surface 64 and steering face 26 are oriented such that they conform, and the backreamer 14 placed around the rock bit 12 as shown in FIG. 6. The backreamer 14 is then moved to the first orientation by installing both pins 40 in corresponding slots 42 as in FIGS. 7 and 9. When pullback and rotation begins, the flange 70 will abut the heel 72, forming shoulder 74, and the cutting face 50 will be rotated by operation of the drill string 22 (FIG. 2). The backreamer is pulled back toward the drill 20 (FIG. 2).

Figure 10:
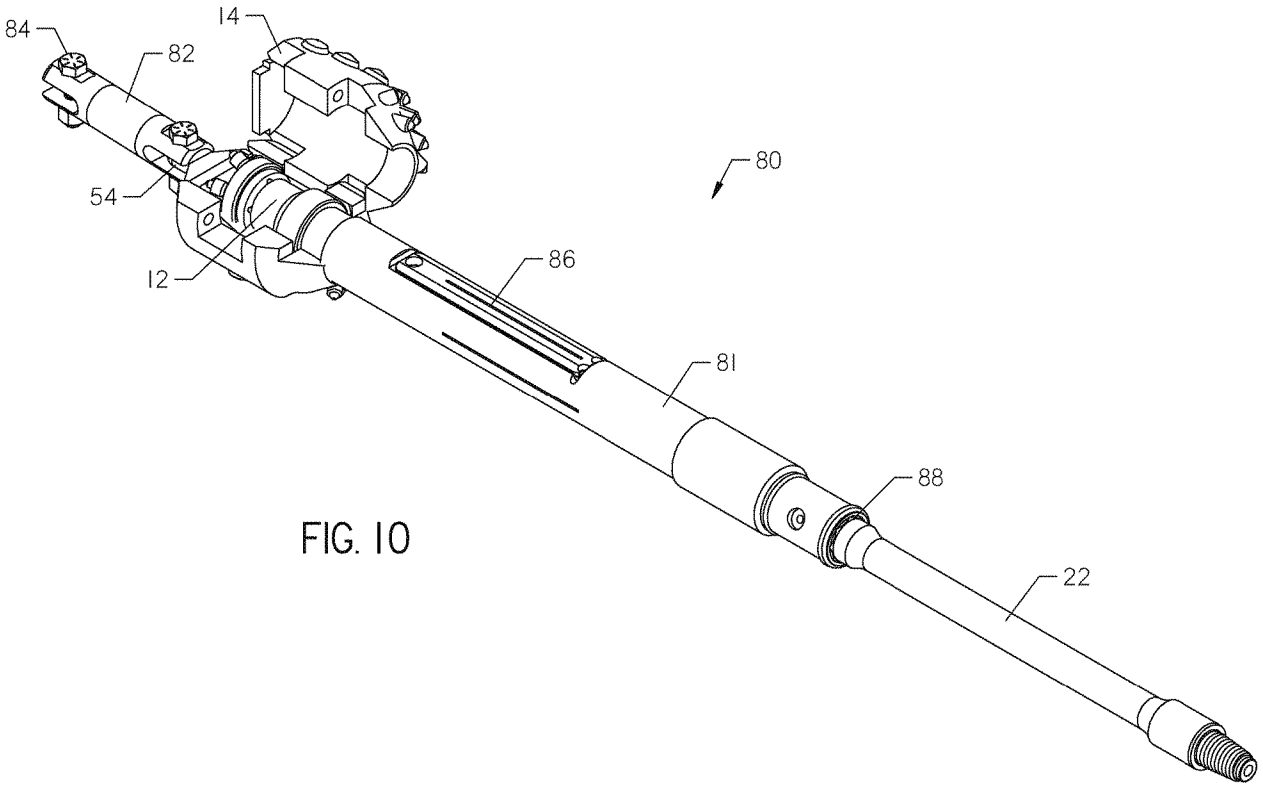
FIG. 10 is a perspective view of a downhole tool assembly comprising the rock bit and backreamer of the present invention.

With reference now to FIG. 10, a downhole assembly 80 incorporating the kit 10 is shown. The assembly 80 comprises a housing 81, the backreamer 14, the rock bit 12, a swivel 82 with a connection 84 to the product pipe 25 (FIG. 2), and a beacon assembly 86. The downhole assembly 80 is connected to the drill string 22 at a connection point 88.

The housing 81 contains electronics such as sensors, transmitters and batteries. Additionally, the housing 81 protects the beacon assembly 86. The beacon may be one of several beacons known in the art. As shown, the beacon assembly 86 includes a protective door. Preferably, the door is electromagnetically transparent. The housing 81 may be of the type described in U.S. Pat. No. 7,600,582 issued to Wright, the contents of which are incorporated herein by reference, though any suitable housing may be used.

The beacon assembly 86 transmits a signal to an above ground tracker, enabling the position of the housing, and therefore the bit 12 and/or the reamer 14 to be known to an operator of the drill 20, and steering corrections to be made.

The swivel 82 attaches to the pullback eye 54. The connection 84 may comprise a clevis, a pullback eye, or other connection point. Use of a swivel allows a product pipe 25 (FIG. 2) to rotate relative to the backreamer 14. The swivel 82 may be a separate piece, as shown, or may be integral with the insert 68 of the backreamer 14.

The drill 20 then provides rotational and pullback force to the backreamer 14 using the drill string 22. Pullback force is transferred from the rock bit 12 to the backreamer 14 due to a flange 70, while rotational force is transferred due to the slanted surface 64 mating with the slanted face 26. Rotating teeth 58 on a cutting surface 50 of the backreamer 14 enlarge the borehole. The backreamer 14 is pulled back to the entry point proximate the drill 20, completing installation of the product pipe 25.

One of ordinary skill in the art will appreciate that variations in the style, shape, and type of rock bit 12 and backreamer 14 may exist without departing from the spirit of the invention.

What is claimed is:

1. A backreamer comprising:

a cutting face comprising a plurality of teeth;

a body having a longitudinal axis and defining an internal cavity, the body being characterized by an internally disposed keying surface, not orthogonal to the axis, and an opening formed proximate the cutting face; and a pullback eye disposed on the body opposite the cutting face;

in which the opening and the internal cavity conform to an external profile of a bit.

2. The backreamer of claim 1 wherein the keying surface is formed at an angle relative to the longitudinal axis.

3. The backreamer of claim 2 wherein the keying surface is planar.

4. The backreamer of claim 1 further comprising a flange disposed proximate the opening such that the flange has a diameter less than a maximum diameter of the internal cavity.

5. The backreamer of claim 1 wherein the body comprises a first section and a second section, wherein the first section and second section are connected by removable connectors and wherein the first section and second section are movable relative to one another when one of the removable connectors is removed.

6. A kit comprising:

the backreamer of claim 1;

wherein the external profile of the bit conforms to the internally disposed keying surface such that the bit is not rotatable relative to the backreamer when the bit is partially disposed within the backreamer.

7. A kit comprising:

a bit comprising a slanted steering face, a heel, and a connection point configured to connect to a drill string;

a backreamer comprising a cutting face and a body defining an internal cavity;

wherein the internal cavity is characterized by an internally disposed surface complementary to the slanted steering face of the bit.

8. The kit of claim 7 wherein the backreamer comprises a flange having a smaller diameter than the diameter of the heel, such that when the backreamer is disposed about the bit, the heel and flange meet at a shoulder.

9. The kit of claim 7 wherein the backreamer comprises a first section and a second section wherein the first section is formed separately from the second section and wherein each of the first section and second section form at least twenty-five percent of the body.

10. The kit of claim 7 wherein the backreamer comprises a pullback eye disposed opposite the cutting face.

11. The kit of claim 7 wherein the internally disposed surface is a slanted face that is not orthogonal to a longitudinal axis of the backreamer.

12. The kit of claim 7 wherein a longitudinal axis of the backreamer and a longitudinal axis of the bit are substantially parallel when the bit is within the backreamer.

13. The kit of claim 7 wherein a longitudinal axis of the backreamer and a longitudinal axis of the bit are substantially collinear when the bit is within the backreamer.

14. The kit of claim 7 wherein an angle between the slanted steering face and a longitudinal axis of the bit is substantially equal to an angle between the internally disposed surface of the backreamer and a longitudinal axis of the backreamer.

15. The kit of claim 7 wherein the backreamer is not rotatable relative to the bit when the bit is at least partially disposed within the internal cavity and the slanted steering face abuts the internally disposed surface.

16. A method comprising:

drilling a pilot bore with a bit and a drill to an exit point, in which the bit is at a terminal end of a drill string rotated by the drill;

placing a backreamer having an internal cavity about the bit such that the bit is at least partially disposed inside the backreamer;

rotating the drill string and bit to rotate the backreamer; and pulling the backreamer back toward the drill with the bit to enlarge the pilot bore.

17. The method of claim 16 further comprising attaching a product pipe to the backreamer and pulling the product pipe through the enlarged pilot bore.

18. A backreamer comprising:

a first section;

a second section removably attached to the first section; and at least one connector for connecting the first section to the second section;

wherein the first section and the second section may be assembled by the at least one connector such that together they define a body, the body defining a longitudinal axis and having an internally disposed cavity and an externally-disposed cutting face on an end of the body;

in which the internally disposed cavity conforms to an external profile of a bit.

19. The backreamer of claim 18 wherein the body defines an internally disposed keying surface, not orthogonal to the longitudinal axis of the backreamer.

20. The backreamer of claim 19 wherein the keying surface is planar.

21. The backreamer of claim 18 wherein the first section and second section each comprise at least twenty-five percent of the body.

22. A method comprising:

drilling a pilot bore with a drill and the bit to an exit point, in which the bit is at a terminal end of a drill string rotated by the drill;

placing the first and second section of the backreamer of claim 20 about the bit such that the bit is at least partially disposed inside the backreamer;

assembling the first and second section of the backreamer using the at least one connector;

rotating the drill string and bit to rotate the backreamer; and pulling the backreamer back toward the drill with the bit to enlarge the pilot bore.

* * * * *